US006935315B2

(12) United States Patent
Seymour, II

(10) Patent No.: US 6,935,315 B2
(45) Date of Patent: Aug. 30, 2005

(54) HIGH VOLUME ACTUATING FLUID RAIL

(75) Inventor: Kenneth R. Seymour, II, Sheboygan, WI (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 18 days.

(21) Appl. No.: 10/816,244

(22) Filed: Apr. 1, 2004

(65) Prior Publication Data

US 2005/0139196 A1 Jun. 30, 2005

Related U.S. Application Data

(60) Provisional application No. 60/533,201, filed on Dec. 30, 2003.

(51) Int. Cl.[7] ..... F02M 55/02
(52) U.S. Cl. ..... 123/456; 123/468
(58) Field of Search ..... 123/456, 468, 123/469, 470

(56) References Cited

U.S. PATENT DOCUMENTS 6,269,796 B1 * 8/2001 Mitchell ..... 123/468
6,338,334 B1 * 1/2002 Ando ..... 123/456
6,843,217 B2 * 1/2005 Zwick et al. ..... 123/143 C
2004/0118381 A1 * 6/2004 Knight et al. ..... 123/447

* cited by examiner

*Primary Examiner*—Thomas Moulis
(74) *Attorney, Agent, or Firm*—Susan L. Lukasik; Dennis Kelly Sullivan; Jeffrey P. Calfa

(57) ABSTRACT

A fluid rail for conveying an actuating fluid under pressure from an actuating fluid source to a respective fuel injector of an internal combustion engine includes a rail assembly being disposable in a space defined in part by a rocker arm carrier of the engine and having;

a. a first rail portion having a substantially cylindrical inside diameter defining a first substantially cylindrical flow passage;
b. a second rail portion having a substantially cylindrical inside diameter defining a second substantially cylindrical flow passage;
c. having a volume of between 15 cubic inches and 60 cubic inches.

A method of conveying an actuating fluid under pressure from an actuating fluid source to a respective fuel injector of an internal combustion engine is further included.

34 Claims, 7 Drawing Sheets

HIGH VOLUME ACTUATING FLUID RAIL

RELATED APPLICATIONS

The present application is related to co-pending U.S. patent application Ser. No. 10/177,202, filed Jun. 21, 2002 and assigned to the present assignee, the entirety of which is included herein by reference. The present application further claims the benefit of U.S. Provisional Application No. 60/533,201, filed Dec. 30, 2003, the entirety of which is also included herein by reference.

TECHNICAL FIELD

The present invention relates to fluid rails for internal combustion engines. More particularly, the present invention relates to a design for attenuating undesireable emissions from such rails and stabilizing conditions in such rails.

BACKGROUND OF THE INVENTION

Hydraulically actuated, electronically controlled, unit fuel injection systems (HEUI) use an actuating fluid (the actuating fluid preferably being engine lubricating oil, but other fluids are acceptable) rail to provide actuation actuating fluid to each injector for generating high pressure fuel for the injection process. The actuating fluid rail typically has its actuating fluid supply provided by a high-pressure actuating fluid pump driven by the engine drive shaft. The pressure in the actuating fluid rail is typically controlled by an Injection Pressure Regulator (IPR) valve, which determines the actuating fluid pressure in the rail depending on engine operating conditions.

Each injector has an actuating fluid control valve that is electronically controlled to control the timing and amount of the actuating fluid flowing into the injector. The actuating fluid control valve initiates and terminates the injection process.

V-form engines typically have a separate actuating fluid rail servicing each of the two banks of cylinders respectively. At the actuating fluid flow inlet of each rail, there may be a check valve in place to isolate the fluid communications between the separate rails servicing the two banks. For a V8 configuration, there are two rails with four injectors attached to each rail. For a V6 configuration, there are also two rails, but with three injectors attached to each rail. For an inline (typically I6) configuration, there is only one rail with six injectors attached to it and there is no check valve at the actuating fluid flow inlet as no rail isolation is needed for a single rail configuration.

The prior art actuating fluid rail is a single elongate straight tube that preferably has a cylindrical shape and a generally cylindrical fluid passageway defined therein and having a volume of about 15 cu. in. The actuating fluid is able to flow freely in the fluid passageway with the least amount of flow restrictions between the locations where injectors are connected to the rail. For the V8 and V6 configuration, the two actuating fluid rails are both connected through actuating fluid flow passages to the high-pressure actuating fluid pump, but separated by the aforementioned check valves at the inlet of the respective rails. These check valves provide isolation between the two actuating fluid rails for limiting the pressure dynamics inside a one of the actuating fluid rails from inducing unwanted pressure dynamics in the other actuating fluid rail.

During normal engine operating conditions, the injectors are actuated at evenly spaced times. When the injector is actuated for injection, the injector control valve opens for an interval and then closes providing the necessary amount of actuating fluid for the injection event in the interval. For an injection event that comprises single shot operation, the injector control valve opens and closes once. For an injection event that includes pilot operation (a small pilot injection followed by a much larger main injection), the valve opens and closes twice or more. When the control valve opens and closes either for a single shot injection event or for a multiple shot injection event, it generates a considerable amount of dynamic disturbance in the actuating fluid in the actuating fluid rail.

First, during the opening period of the control valve, there is relatively large amount of actuating fluid flowing from the actuating fluid rail into the injector for injection actuation. This causes a pressure drop in the actuating fluid rail. This pressure drop is then recovered by the supply actuating fluid flow from the high-pressure pump. Second, the open and close of the injector control valve generates fluid pressure waves along the actuating fluid rail. This pressure wave propagates along the axial direction of the actuating fluid rail with a frequency primarily determined by the length of the actuating fluid rail and the bulk modulus of the actuating fluid.

Since the length of the rail is determined to a large extent by the engine configuration, the frequency varies depending on the engine configuration. For V8 and V6 configurations, the frequency is around 1000–2000 HZ; for 16 configuration, the frequency could be lower due to a longer rail, for example 800–1000 HZ. Because of this pressure wave, there is an unbalanced axial force on the actuating fluid rail since the pressure along the actuating fluid rail is different due to different time delay, or phase lag, at different locations along the actuating fluid rail. This unbalanced force has the same frequency as the pressure wave in the rail. The pressure wave interacts with the actuating fluid rail structure. A fraction of the pressure fluctuation energy converts to the undesirable air-borne acoustic energy. Also, the actuating fluid rail transmits an excitation with the above-mentioned frequency through the bolts connecting the rail to the rest of the engine (for bolt on rails). The same phenomenon occurs in rails formed in the engine structure. In both cases, this excitation then generates an audible noise with the same range of the above noted frequencies.

The audible noise resulting from the acoustic waves is objectionable and must meet NVH (noise, vibration, and harshness) standards. A goal might be that a compression ignition engine be no more noisy than a typical spark ignition engine. Such a level of noise is deemed to be generally acceptable. This is not presently the case, however. In order to meet this goal, a number of sources of noise from the compression ignition engine need to be addressed. As indicated above, one such source is the acoustic emissions generated in the actuating fluid rail. There is then a need in the industry to attenuate the acoustic waves generated in the rail. Further, there is a need for the HEUI type injectors to meet the mandated particulate emissions from the engine by being properly calibrated. Calibration of the injectors depends to a certain extent on the rail dynamics characteristics of the actuating fluid rail.

SUMMARY OF THE INVENTION

The present invention meets the aforementioned needs of the industry. The present design was chosen to package a significantly larger volume of actuating fluid rail in an existing relatively small space defined in part in the rocker arm carrier of an engine. Such expanded volume is an absolute necessity for the HEUI injection system to meet emissions standards, both NVH and particulate, mandated for the model year 2004. The increased actuating fluid volume of the actuating fluid rail permits the HEUI injectors to be calibrated in such a manner as to meet those emissions standards. The rail of the present invention is advantageously packaged in the same rocker arm carrier as the prior art single tubular rail.

In the past, an exemplary actuating fluid rail had a volume of about 15 cu in and was formed of a single straight cylindrical rail. The calibration of the engine with such an actuating fluid rail would not comply with 2004 model year emissions regulations. Increasing the actuating fluid volume of the actuating fluid rail minimizes rail fluid dynamics and allows the calibration of the injectors to be changed to allow a certain engine to meet 2004 model year emissions standards. For an actuating fluid rail servicing four injectors of a bank of a particular V8 engine, the goal was to design an actuating fluid rail having an oil volume of between 20 and 50 cu in. Preferably, the actuating fluid rail has an oil volume of 30 cu in. In a particular engine with particular HEUI injectors, such an oil volume has been found to eliminate rail dynamics that prevent proper function of the HEUI injection system, such as is necessary to meet the 2004 model year emissions standards. Ideally, a single cylindrical rail of the needed volume would be best but such a rail would not fit in the existing space. The present design has both the needed volume and fits in the existing space in the the certain rocker arm carrier.

The present invention is a fluid rail for conveying an actuating fluid under pressure from an actuating fluid source to a respective fuel injector of an internal combustion engine includes a rail assembly being disposable in a space defined in part by a rocker arm carrier of the engine and having;

a. a first rail portion having a substantially cylindrical inside diameter defining a first substantially cylindrical flow passage;

b. a second rail portion having a substantially cylindrical inside diameter defining a second substantially cylindrical flow passage;

c. at least one tubular interconnecting fluid coupling fluidly connected to the first rail portion and to the second rail portion for conveying actuating fluid therebetween, the tubular interconnecting fluid coupling having a substantially cylindrical inside diameter defining an interconnecting cylindrical flow passage; and d. having a volume of between 15 cubic inches and 60 cubic inches.

The present invention is further a method of conveying an actuating fluid under pressure from an actuating fluid source to a respective fuel injector of an internal combustion engine.

DETAILED DESCRIPTION OF THE DRAWINGS

The actuating fluid rail of the present invention having a relatively high oil volume is shown generally 10 in the figures. The rail 10 is preferably formed, by casting, forging, or the like, as a single unit. The rail 10 preferably has two generally parallel rail portions, a straight rail 10*a* and a wavy rail 10*b*. A plurality of connecting passages 40 fluidly connect the straight rail 10*a* with the wavy rail 10*b*. Preferably, there are six such connecting passages 40.

Figure 1:
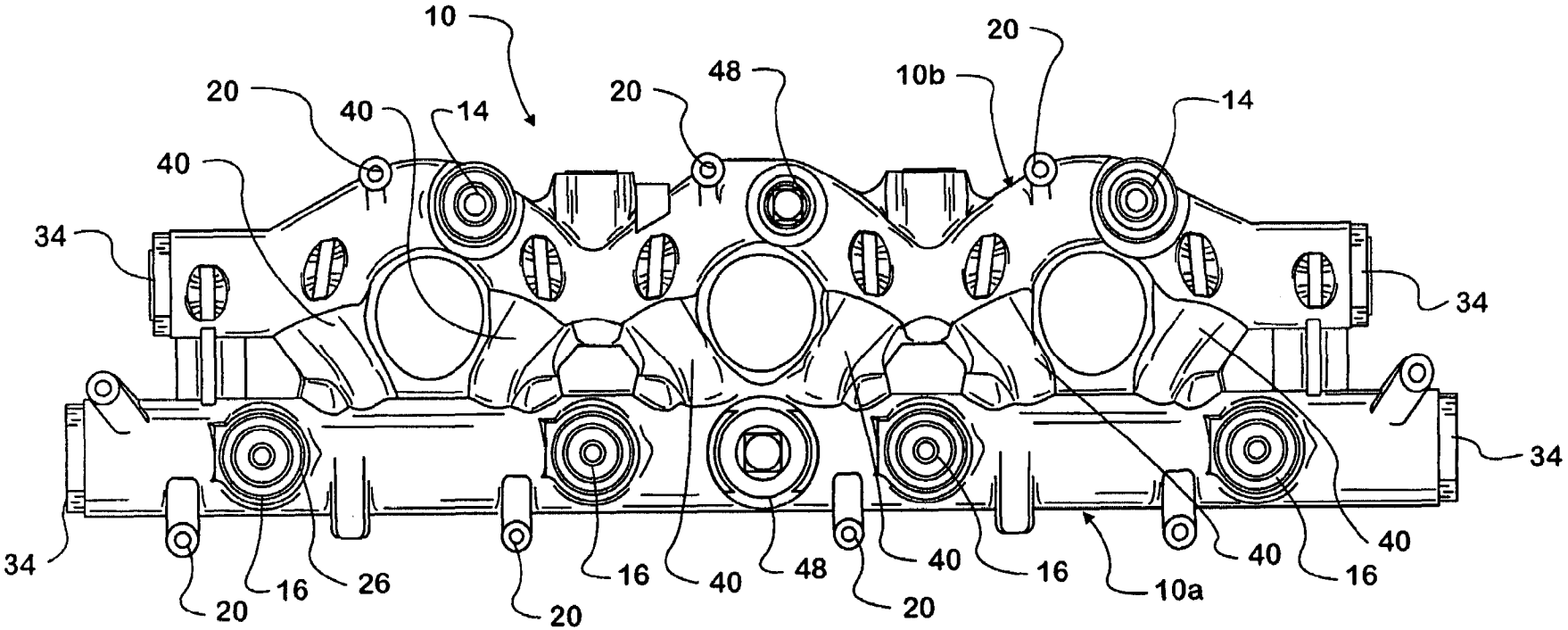
FIG. 1 is a top plan form view of the actuating fluid rail of the present invention.
Figure 6:
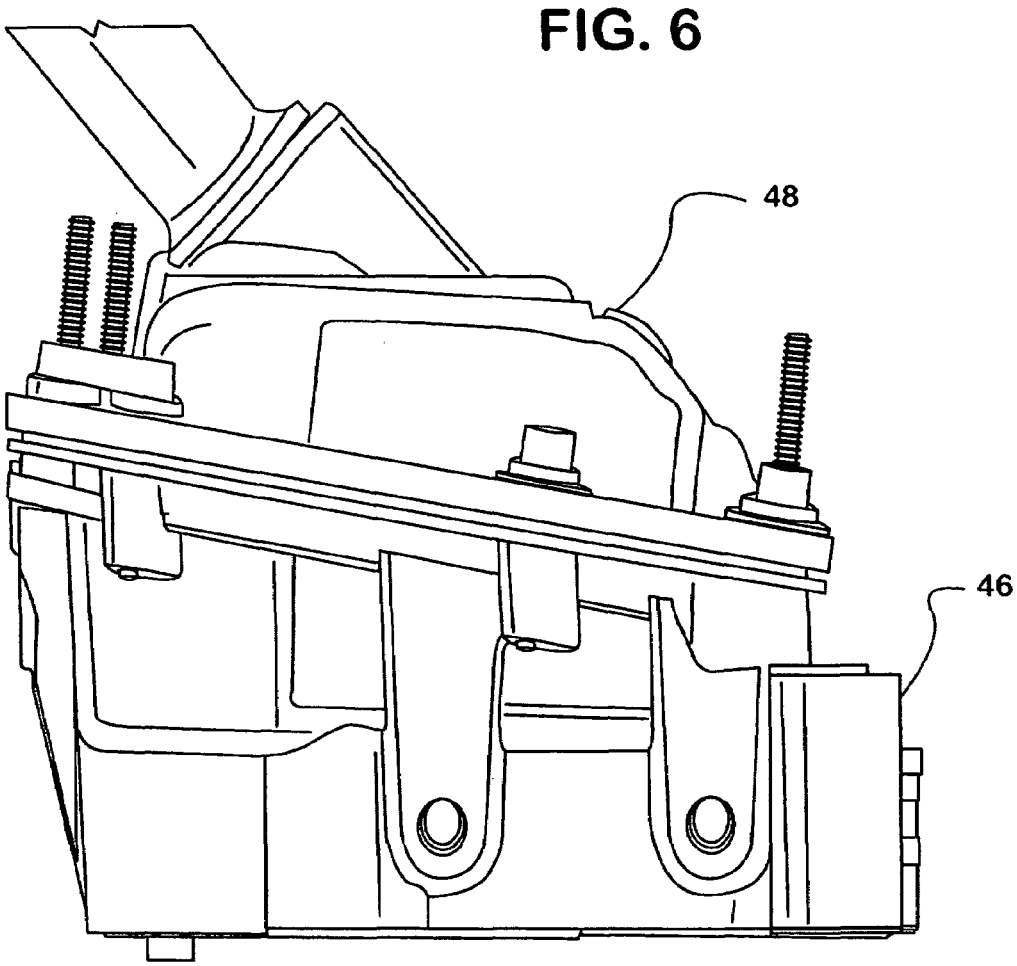
FIG. 6 is an elevational end view of an exemplary covered rocker arm carrier in which the rail of the present invention is disposed.
Figure 7:
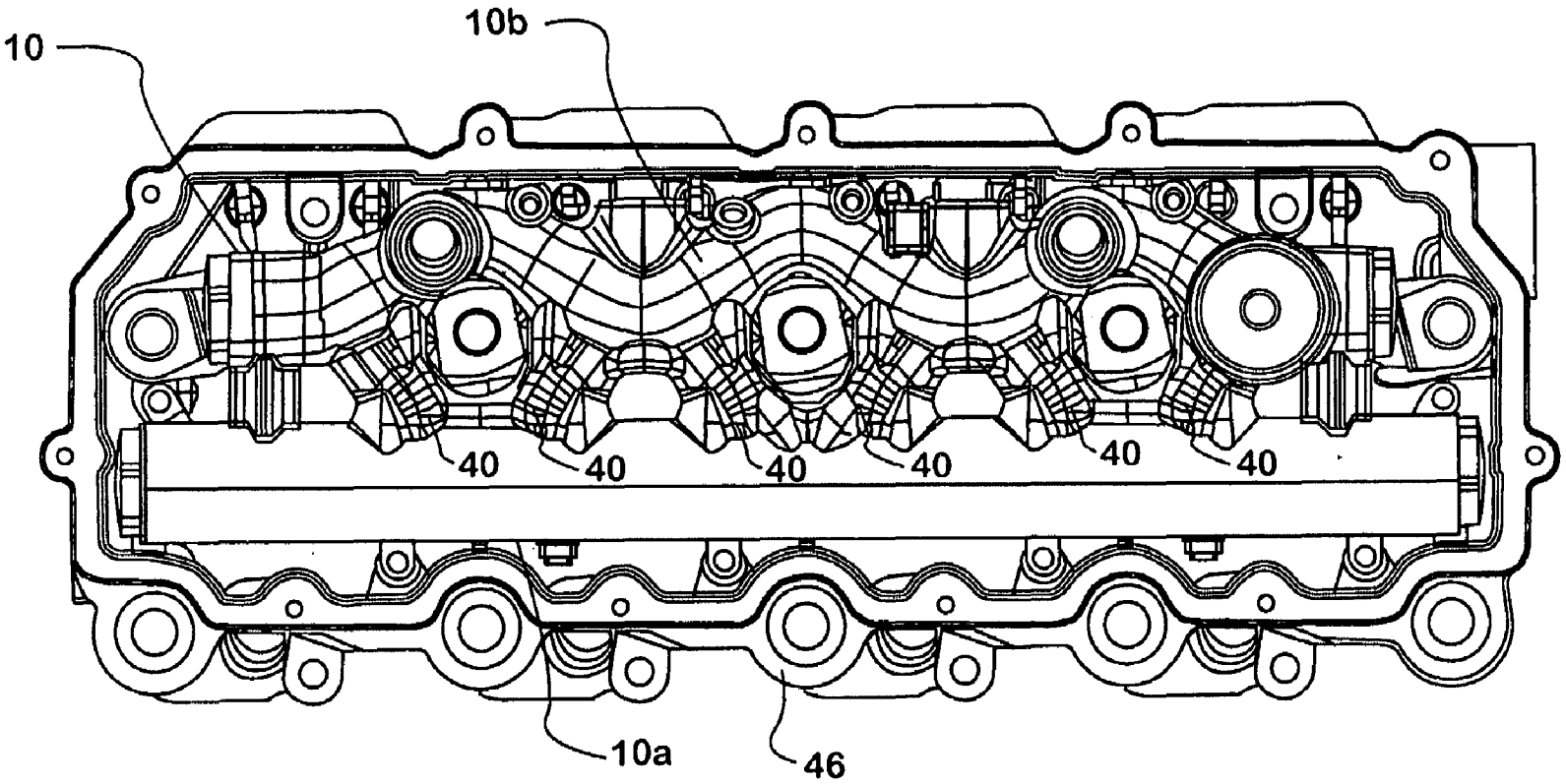
FIG. 7 is a top plan form view of the actuating fluid rail integrated with the exemplary rocker arm carrier.

As depicted in FIGS. 6 and 7, the location of the rail 10 is directly over the valve train of an engine, the valve train being disposed in the rocker arm carrier 46. The rail 10 may be disposed next to a breather and is preferably completely enclosed by a valve cover 48. See FIG. 6. The design constraints were to provide for increased volume of the rail 10 substantially within existing space of a known rocker arm carrier 46. Because of the very high internal pressures in the rail 10 (actuating fluid may be at 3,000 to in excess of 5000 psi), the rail 10 preferably has a round cross-section in order to provide adequate strength while minimizing weight and external dimensions. Departing from a round cross-section requires that the walls of the rail 10 are necessarily made very thick in order to contain the noted internal pressures. The necessary thickness of the walls of such a rail is almost prohibitive. The solution selected in the rail 10 of the present invention is to provide the two generally parallel rails 10*a*, 10*b* as depicted in FIG. 1. The straight rail 10*a* directly overlies the fuel injectors of the engine, while the wavy rail 10*b* "snakes" around under the rocker arm carrier cover 48 such that it fits in the current package, but retains the advantageous round shape cross-section. The rail 10 of the present invention packages in the space defined in the rocker arm carrier 46 without modification of the rocker arm carrier 46. See FIGS. 6 and 7. The internal volume of the rail 10 substantially doubles the volume of the rail in the above noted first related application, while maintaining substantially the same strength as the rail noted in the related application. Significantly, combining the wavy rail 10*b* with a straight rail 10*a* increases the volume of the rail 10 while minimizing the weight and packaging room needed. Compared to a single round cross-section cylindrical rail of the same volume, weight is increased somewhat, but such a rail does not meet the packaging space constraints.

Figure 2:
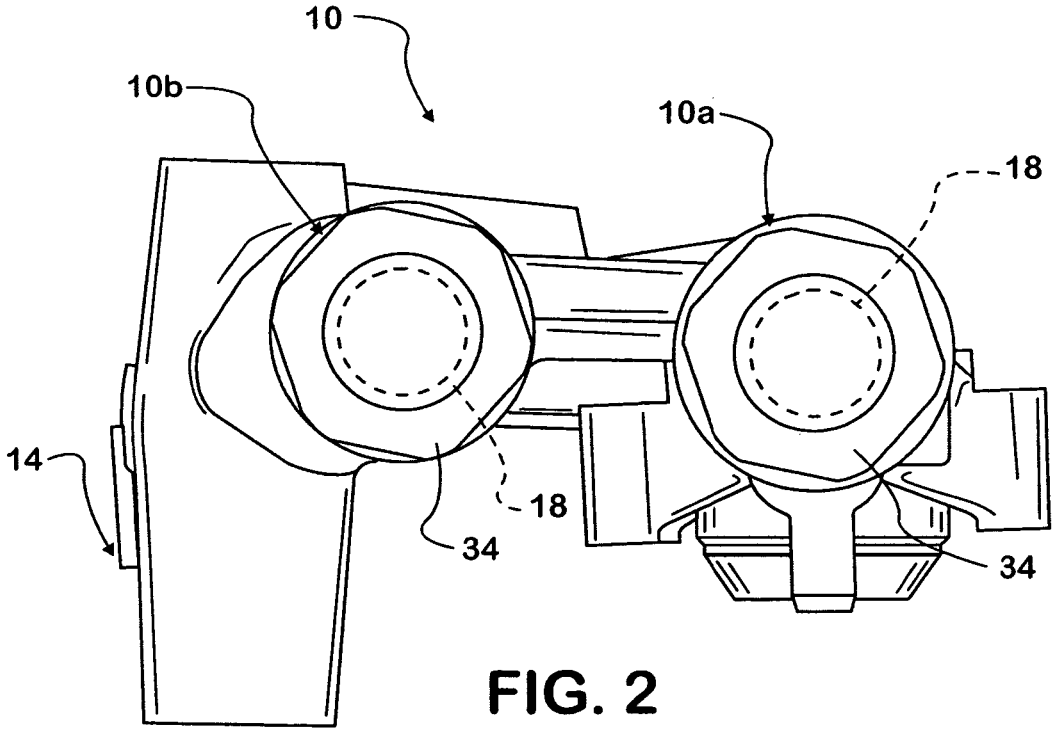
FIG. 2 is an end elevational view of the rail of FIG. 1.
Figure 3:
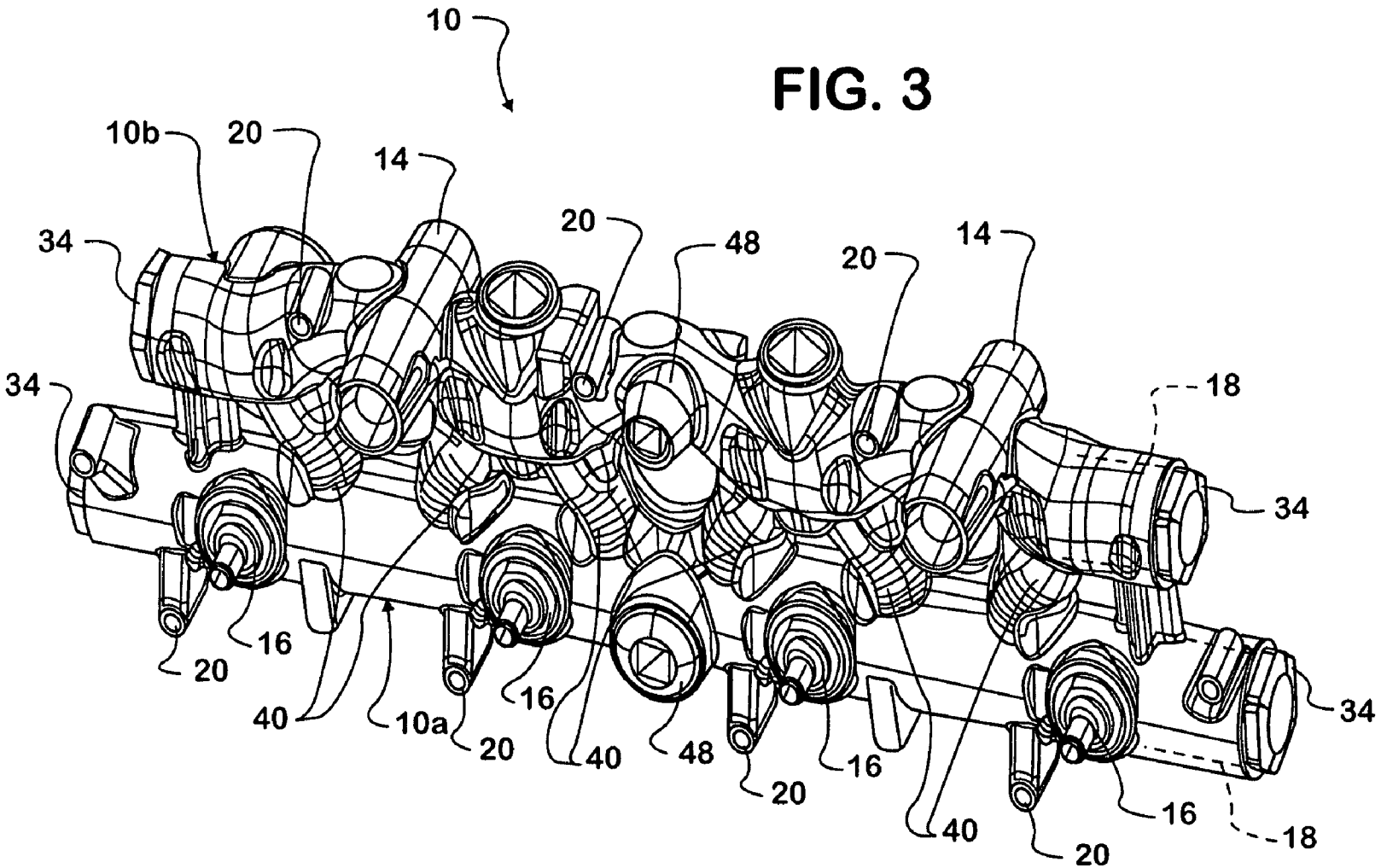
FIG. 3 is a perspective wire frame view of the rail of FIG. 1.
Figure 4:
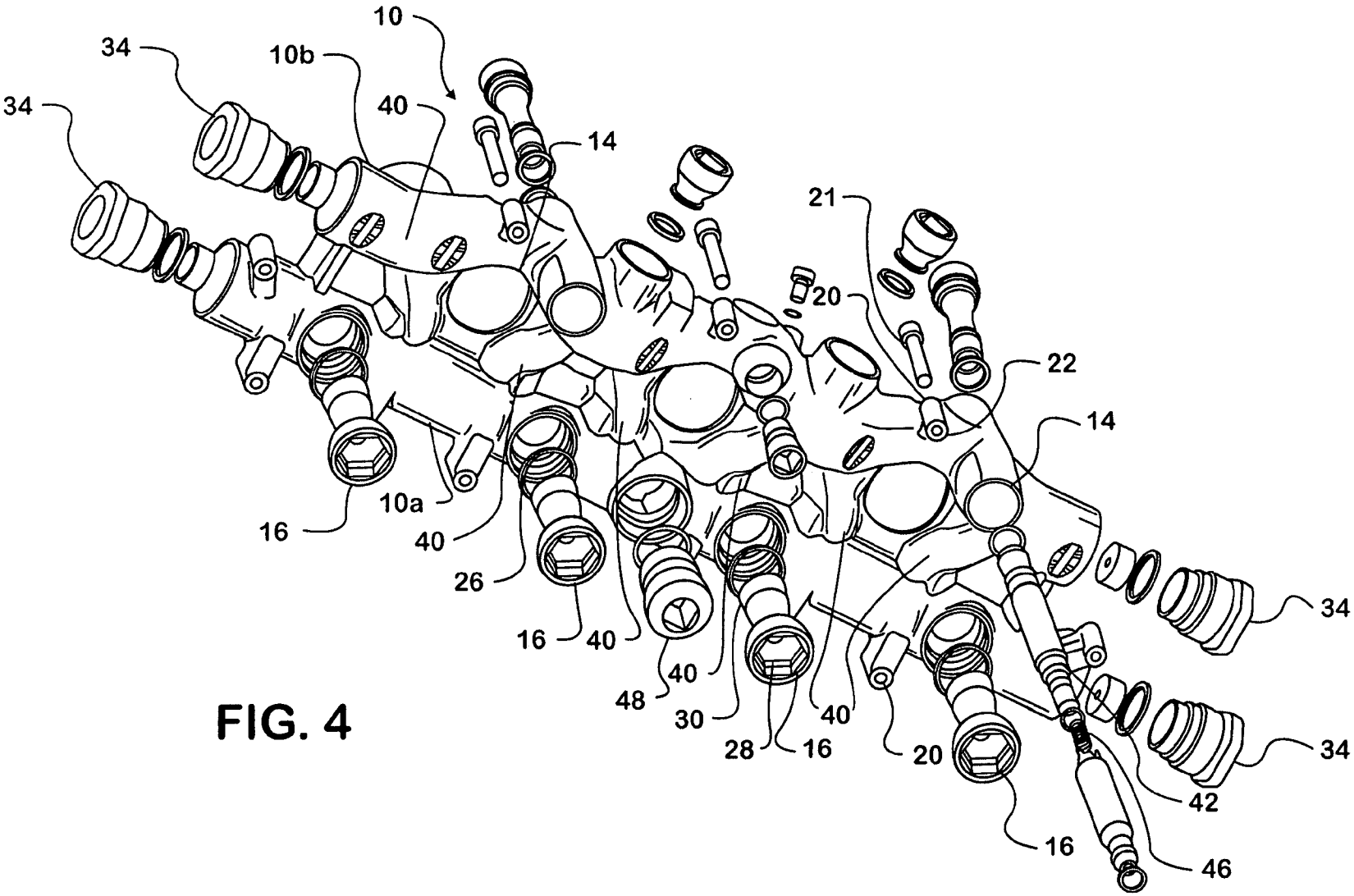
FIG. 4 is a perspective exploded view of the rail.
Figure 5:
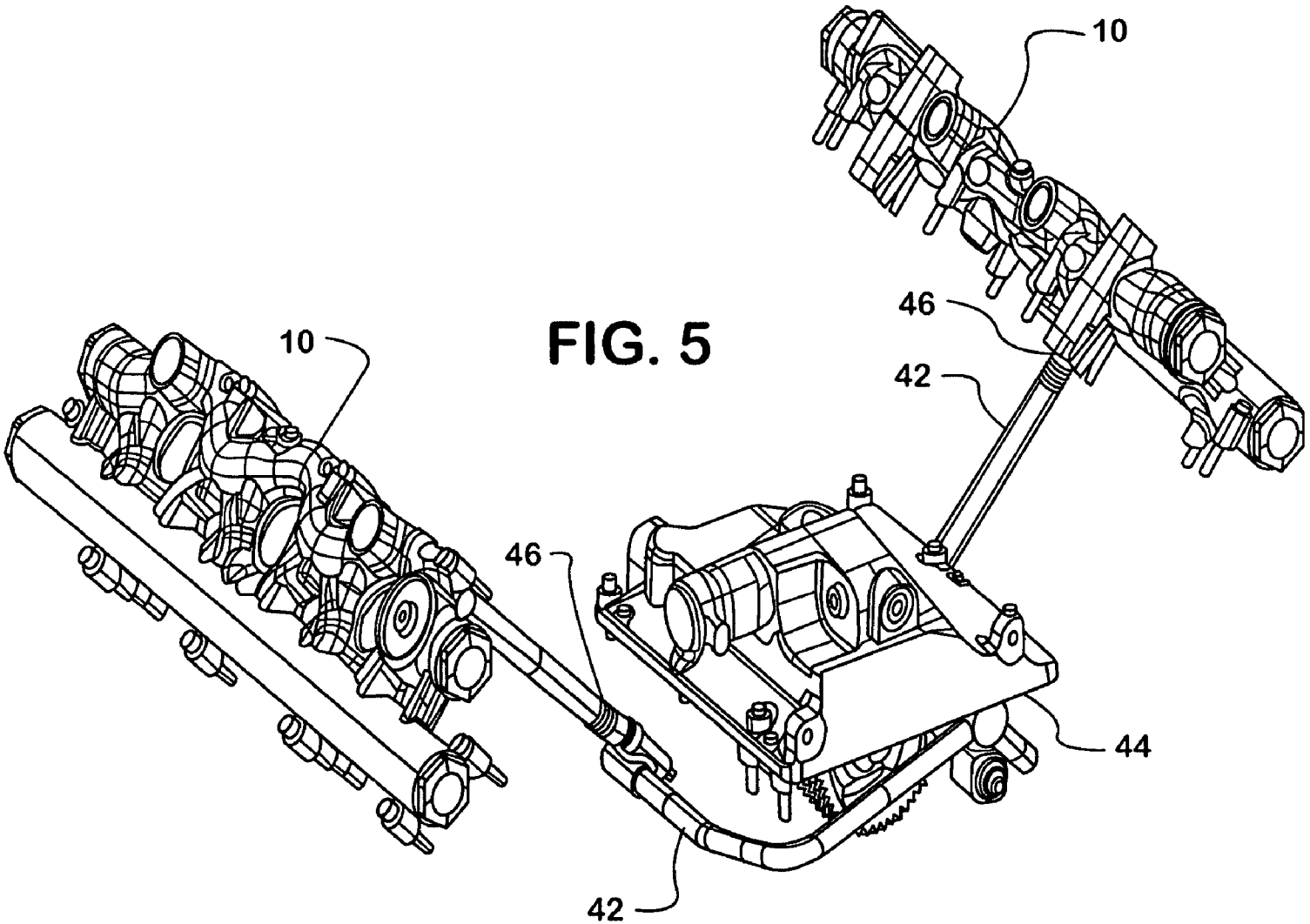
FIG. 5 is a perspective wire frame view of the two actuating fluid rail necessary for a "V" form engine fluidly coupled to an actuating fluid pump.

The actuating fluid rail 10 preferably has a cylindrical shape and a generally cylindrical fluid passageway 18 defined therein, as depicted in FIG. 3. The actuating fluid is able to flow freely in the fluid passageway 18 with the least amount of flow restrictions between the locations of the injector ports 16 where injectors (not shown) are connected to the rail 10. See FIGS. 3 and 4. For the V8 and V6 configuration, the two actuating fluid rails 10 are both connected through actuating fluid flow passages 42 via an injector inlet 14 to a high-pressure actuating fluid pump 44 and separated by check valves 46 that may be advantageously disposed in the injector inlet 14 of the respective rails 10, as depicted in FIGS. 2, 4 and 5. The check valves 46 are disposed between both the pump 44 and the other rail 10. These check valves 46 provide isolation between the two actuating fluid rails 10 and between each rail 10 and the pump 44 for limiting the pressure dynamics occurring inside a one of the actuating fluid rails 10 that is induced by the pressure dynamics in the other actuating fluid rail 10.

FIGS. 1–5 and 7 depict a rail 10 for use with a V8 configured engine. The rail 10 includes the fluid inlet ports 14 for fluidly coupling the rail 10 to the high pressure actuating fluid pump 44 (see FIG. 5). In practice, one or the other of the inlet ports 14 is used, depending on which bank of cylinders the particular rail 10 is servicing, and the unused inlet port 14 is then sealed by a suitable plug. In this way, a single casting can be used for both rails 10.

The actuating fluid rail 10 has a plurality of coupling lugs 20 for coupling the rail 10 to the engine. See FIGS. 1, 3 and 4. This is preferably accomplished by passing a bolt 21 through a bore 22 defined in the lug 20 and threading the bolt into a threaded bore (not shown) defined in the rocker arm carrier 46.

Injector ports 16 may have an aperture 26 that is in communication with the fluid passageway 18. The aperture 26 may define a receiver for receiving a ferrule 28. The ferrule 28 holds a jumper tube 30 in fluid communication with the fluid passageway 18. A ring seal 32 may form a fluid-tight seal between the jumper tube 30 and the fluid passageway 18. The jumper tube 30 is preferably coupled directly to a respective fuel injector and conveys actuating fluid from the fluid passageway 18 to the fuel injector. A respective injector port 16 services each respective fuel injector.

End caps 34 may fluidly seal the respective ends of the fluid passageway 18. The end caps 34, by being removable, assist in the formation of the passageway 18 in the rail 10.

An acoustic wave attenuator (AWA) 48 made substantially in accord with the teachings of the above noted related application may be disposed in the straight rail 10*a* and in the wavy rail 10*b*, as depicted in FIGS. 1, 3 and 4. Further, the end caps 34 may include an AWA, also in accord with the teachings of the above noted related application.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A fluid rail for conveying an actuating fluid under pressure from an actuating fluid source to a respective fuel injector of an internal combustion engine, the fluid rail being disposable in a space defined in part by a rocker arm carrier of the engine, the fluid rail comprising:

a. A first rail portion having a substantially cylindrical inside diameter defining a first substantially cylindrical flow passage;

b. A second rail portion having a substantially cylindrical inside diameter defining a second substantially cylindrical flow passage;

c. A rail fluid outlet defined in a selected one of the rail portions associated with each respective fuel injector serviced by the rail;

d. At least one tubular interconnecting fluid coupling fluidly connected to the first rail portion and to the second rail portion for conveying actuating fluid therebetween, the tubular interconnecting fluid coupling having a substantially cylindrical inside diameter defining an interconnecting cylindrical flow passage; and e. A rail fluid inlet defined in a selected one of the rail portions for fluid communication with the source of actuating fluid.

2. The fluid rail of claim 1 having a plurality of tubular interconnecting fluid couplings.

3. The fluid rail of claim 1 having a wall thickness of between 0.0035 and 0.010 inches.

4. The fluid rail of claim 3 having a wall thickness of substantially 0.005 inches.

5. The fluid rail of claim 1 the first rail portion and the second rail portion being spaced apart in a substantially parallel disposition.

6. The fluid rail of claim 1 the at least one tubular interconnecting fluid passage spanning the space between the first rail portion and the second rail portion.

7. The fluid rail of claim 1, a one of the rail portions having a wavy shape.

8. The fluid rail of claim 6, the second of the rail portions having a straight shape.

9. The fluid rail of claim 1 being cast of a metallic material.

10. The fluid rail of claim 1 being cast as a unitary, integral structure.

11. The fluid rail of claim 1 having a volume of between 15 cubic inches and 60 cubic inches.

12. The fluid rail of claim 11 having a volume of substantially 30 cubic inches.

13. A fluid rail for conveying an actuating fluid under pressure from an actuating fluid source to a respective fuel injector of an internal combustion engine, the fluid rail comprising:

a. a rail assembly being disposable in a space defined in part by a rocker arm carrier of the engine and having;

b. a first rail portion having a substantially cylindrical inside diameter defining a first substantially cylindrical flow passage;

c. a second rail portion having a substantially cylindrical inside diameter defining a second substantially cylindrical flow passage;

d. at least one tubular interconnecting fluid coupling fluidly connected to the first rail portion and to the second rail portion for conveying actuating fluid therebetween, the tubular interconnecting fluid coupling having a substantially cylindrical inside diameter defining an interconnecting cylindrical flow passage; and e. having a volume of between 15 cubic inches and 60 cubic inches.

14. The fluid rail of claim 1 having a plurality of tubular interconnecting fluid couplings.

15. The fluid rail of claim 1 having a wall thickness of between 0.0035 and 0.010 inches.

16. The fluid rail of claim 3 having a wall thickness of substantially 0.005 inches.

17. The fluid rail of claim 1 the first rail portion and the second rail portion being spaced apart in a substantially parallel disposition.

18. The fluid rail of claim 1 the at least one tubular interconnecting fluid passage spanning the space between the first rail portion and the second rail portion.

19. The fluid rail of claim 1, a one of the rail portions having a wavy shape.

20. The fluid rail of claim 6, the second of the rail portions having a straight shape.

21. The fluid rail of claim 1 being cast of a metallic material.

22. The fluid rail of claim 1 being cast as a unitary, integral structure.

23. The fluid rail of claim 11 having a volume of substantially 30 cubic inches.

24. A method of conveying an actuating fluid under pressure from an actuating fluid source to a respective fuel injector of an internal combustion engine, the method comprising:

disposing a rail assembly in a space defined in part by a rocker arm carrier of the engine;

forming a first rail assembly portion having a substantially cylindrical inside diameter defining a first substantially cylindrical flow passage;

forming a second rail assembly portion having a substantially cylindrical inside diameter defining a second substantially cylindrical flow passage;

forming at least one tubular interconnecting fluid coupling fluidly connected to the first rail portion and to the second rail portion for conveying actuating fluid therebetween, the tubular interconnecting fluid coupling having a substantially cylindrical inside diameter defining an interconnecting cylindrical flow passage; and defining a volume of between 15 cubic inches and 60 cubic inches in the rail assembly.

25. The method of claim 24 including forming a plurality of tubular interconnecting fluid couplings.

26. The method of claim 24 including forming a rail assembly wall with a wall thickness of between 0.0035 and 0.010 inches.

27. The method of claim 26 including forming a rail assembly wall with a wall thickness of substantially 0.005 inches.

28. The method of claim 24 including spacing the first rail assembly portion and the second rail assembly portion apart in a substantially parallel disposition.

29. The method of claim 24 including disposing the at least one tubular interconnecting fluid passage to span the space between the first rail assembly portion and the second rail assembly portion.

30. The method of claim 24, including froming a one of the rail assembly portions of a wavy shape.

31. The method of claim 30, including forming the second of the rail assembly portions of a straight shape.

32. The method of claim 24 including casting the rail assembly of a metallic material.

33. The method of claim 24 including casting the rail assembly as a unitary, integral structure.

34. The fluid rail of claim 24 including defining the rail assembly volume of substantially 30 cubic inches.

* * * * *